US006857331B2

(12) United States Patent
Yeh

(10) Patent No.: US 6,857,331 B2
(45) Date of Patent: Feb. 22, 2005

(54) STRUCTURE OF AN ENGINE STARTER OF A REMOTE-CONTROLLED CAR

(76) Inventor: Chih-Wei Yeh, 11F-6, No. 250, Sec. 4, Chung-Hsiao, E. Rd., Taipei (TW)

( * ) Notice: Subject to any disclaimer, the term of this patent is extended or adjusted under 35 U.S.C. 154(b) by 148 days.

(21) Appl. No.: 10/265,416

(22) Filed: Oct. 7, 2002

(65) Prior Publication Data

US 2004/0065161 A1 Apr. 8, 2004

(51) Int. Cl.[7] ..... F02N 1/00
(52) U.S. Cl. ..... 74/7 C; 192/42; 192/46
(58) Field of Search ..... 74/6, 7 R, 7 C, 74/7 E; 192/42, 46

(56) References Cited

U.S. PATENT DOCUMENTS 2,566,445 A * 9/1951 Gilbert et al. ..... 74/7 C
2,942,481 A * 6/1960 Gilbert ..... 74/7 C
3,114,270 A * 12/1963 Buxton et al. ..... 74/6
3,327,821 A * 6/1967 Digby ..... 192/63
3,458,019 A * 7/1969 Bunger et al. ..... 192/42
4,638,775 A * 1/1987 Lindstrom ..... 123/185.9
4,744,258 A * 5/1988 Volino ..... 74/7 R
5,095,865 A * 3/1992 Keister ..... 123/179.5
5,307,701 A * 5/1994 Thonnard ..... 74/7 E
5,715,783 A * 2/1998 Osakabe et al. ..... 123/185.3
6,167,858 B1 * 1/2001 Murakami ..... 123/185.3

* cited by examiner

*Primary Examiner*—David M. Fenstermacher
(74) *Attorney, Agent, or Firm*—Troxell Law Office PLLC

(57) ABSTRACT

A structure for a starter (driver) of a miniaturized remote control model car engine is able to perform perfect separation of the starter shaft from the engine as soon as the engine has built up its normal speed with the aid of the slanted surface and chamfered edges formed on its coupling plate, and the retrieved starter shaft never forwardly excurses to recontact the engine shaft by a steel ball positioning device. With this structure, the extra mechanical loss and damage to the mechanical parts can be prevented in model car engines operated at an extra high speed.

7 Claims, 7 Drawing Sheets

STRUCTURE OF AN ENGINE STARTER OF A REMOTE-CONTROLLED CAR

BACKGROUND OF THE INVENTION

1. Field of the Invention

The present invention relates to an improved structure for a driver of a remote-controlled car, and in particular, to an improved engine starter for a remote control miniature model car capable of saving mechanical power loss and avoiding abrasion to the component parts of the structure.

2. Description of the Prior Art

To play a remote control miniaturized model car is a popular hobby nowadays. Present precise engineering techniques have realized producing a miniaturized model car with sophisticated components, which function fantastically as if those were of a real car.

The conventional well-known remote control miniaturized model car requires a starter (driver) to initiate its engine. There are generally two types of starter available, a manual pull type and a motor starting type. The principle of favorably used motor starting type will be illustrated accompanying with FIGS. 1A, 1B hereinbelow.

As shown in FIGS. 1A and 1B, the motor starter comprises a motor 11, a speed reduction gear set 12, and a starter shaft 13. The speed reduction gear set 12 accommodated in a gear box 14 further includes a planetary gear set and several gears. A hexagonal hole is provided at the center of an output side gear 15 for accommodating a hexagonal nut 16, and a one-way clutch sleeve 17 perforates therethrough. At the other side of the gear box 14 at the position facing against the one-way clutch sleeve 17, there is a rear cover 18 having a nipple chuck 19 for one end of the starter shaft 13 to pass through until reaching the inner portion of the one-way clutch sleeve 17 so as to stably conjoin with each other. The other end of the starter shaft 13 is formed into flare shape with confinement notches 131 for in mesh with a rear car engine shaft so as to initiate the model car engine 20. The manual pull type starter, with which the engine of a model car is initiated by pulling a rope wound on the gear shaft thereof, is shown in FIG. 1C.

Returning to FIGS. 1A and 1B, as soon as the motor 11 starts, the power to initiate the car engine 20 is transmitted through the route the speed reduction gear set 12→the output side gear 15→the hexagonal nut 16→the one way clutch sleeve 17→the starter shaft 13→the rear car engine shaft→the car engine. As soon as the car engine has built up its normal rotating speed, the one-way clutch sleeve 17 automatically floats and unmeshes with the starter shaft 13 so as to avoid destructing the gear mechanism.

Meanwhile, the aforementioned conventional starter (driver) structure for initiating the miniaturized model car engine has several noticeable disadvantages, namely:

1. In the time when the car engine is initiated but the rear engine shaft has not yet released from meshing with the starter shaft, the starter shaft itself together with the rear cover and the nipple chuck become loads to the car engine resulting in an obstacle for the car engine to build up its revolutional speed in a short time.
2. The one way clutch sleeve encircling the starter shaft is impossible to perform perfect separation from the engine shaft when the car engine has reached its normal speed, but instead, slightly in touch with the starter shaft causing extra mechanical power loss.
3. The phenomenon mentioned above further causes the one-way clutch sleeve to yield by a high temperature arising from friction.

It is what the object the inventor has endeavored for years by continuous research and experiment trying to find out the remedy to rectify the inherent shortcomings of the conventional techniques, and at last has succeeded in realizing the present invention.

SUMMARY OF THE INVENTION

Accordingly, it is the object of the present invention to provide a starter (driver) for a remote control miniaturized model car capable of eliminating the aforementioned shortcomings inherent to the conventional starter structure.

In the present invention, to enable the one way clutch sleeve to perform perfect separation from the starter shaft as soon as the car engine has attained its normal speed, the coupled part of the starter shaft with the rear engine shaft is formed into a slanted surface with chamfered edges so as to smoothen the slide movement between the two shafts thereby preventing extra mechanical power loss and early yielding of the clutch sleeve. Furthermore, a steel ball provided at the end terminal of the starter shaft serves to fix the starter shaft at a relevant retrieval position after its separation from the rear engine shaft so as to prevent excursion of the starter shaft due to vibration of the car engine.

For fuller understanding of the nature, objects and advantages of the invention, reference should be made to the following detailed descriptions taken in conjunction with the accompanying drawings.

DETAILED DESCRIPTION OF THE PREFERRED EMBODIMENT

Figure 1A:
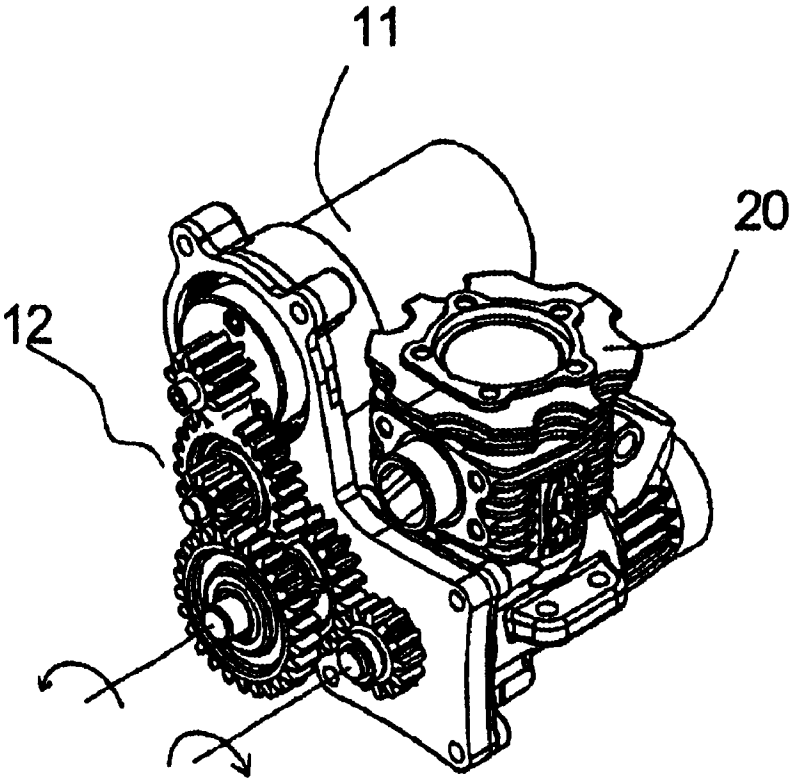
FIG. 1A PRIOR ART
FIG. 1A is a three-dimensional assembly view of a conventional model car engine with its starting motor.
Figure 1C:
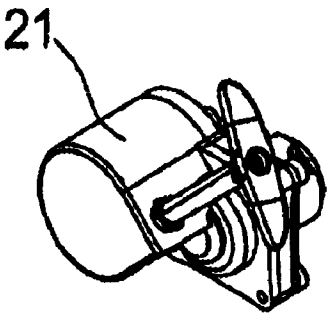
FIG. 1C PRIOR ART
FIG. 1C is a three-dimensional assembly view of a conventional manual pull type starter.
Figure 1B:
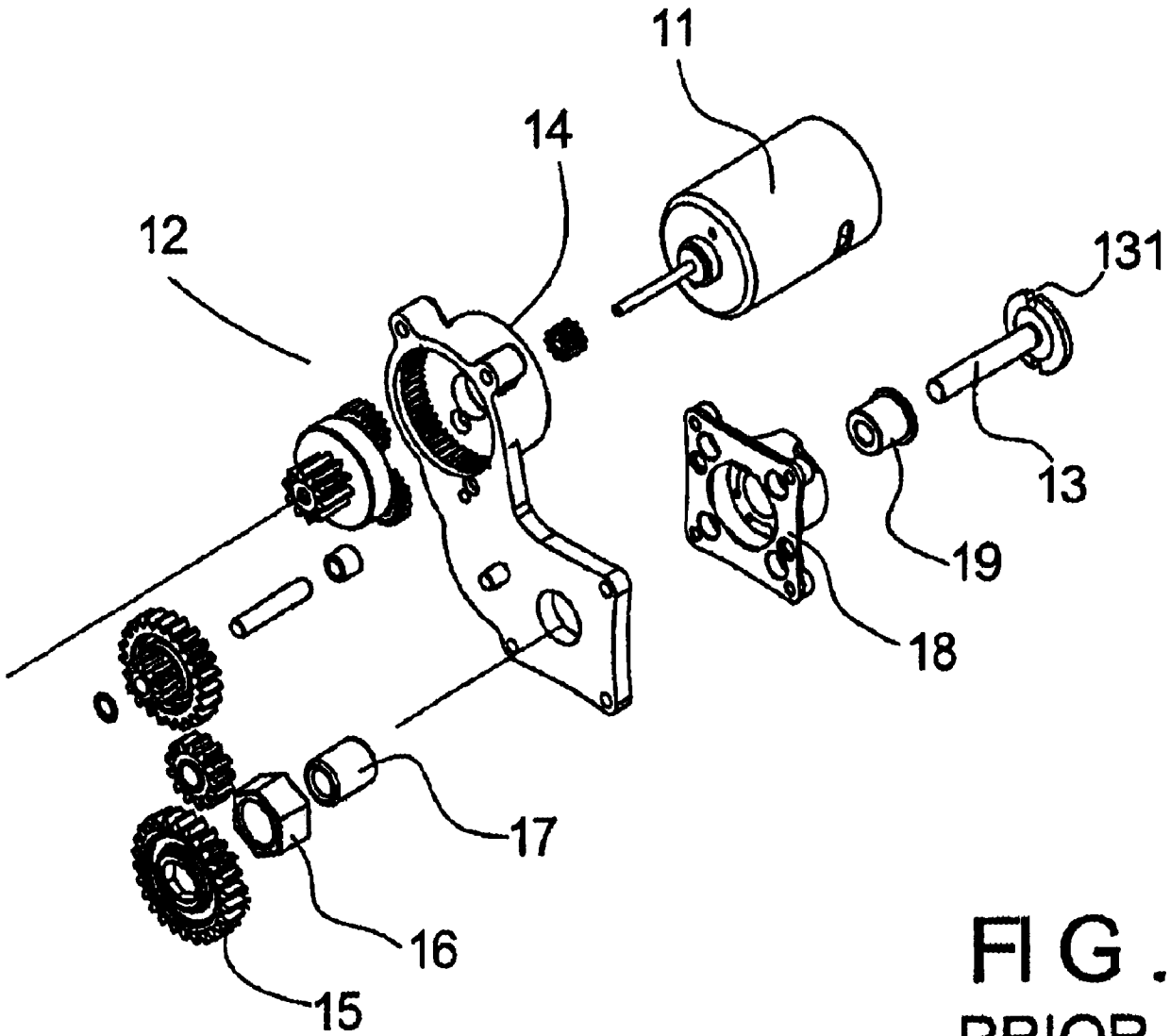
FIG. 1B PRIOR ART
FIG. 1B is an illustrative exploded view showing component parts of a conventional starting motor.
Figure 2:
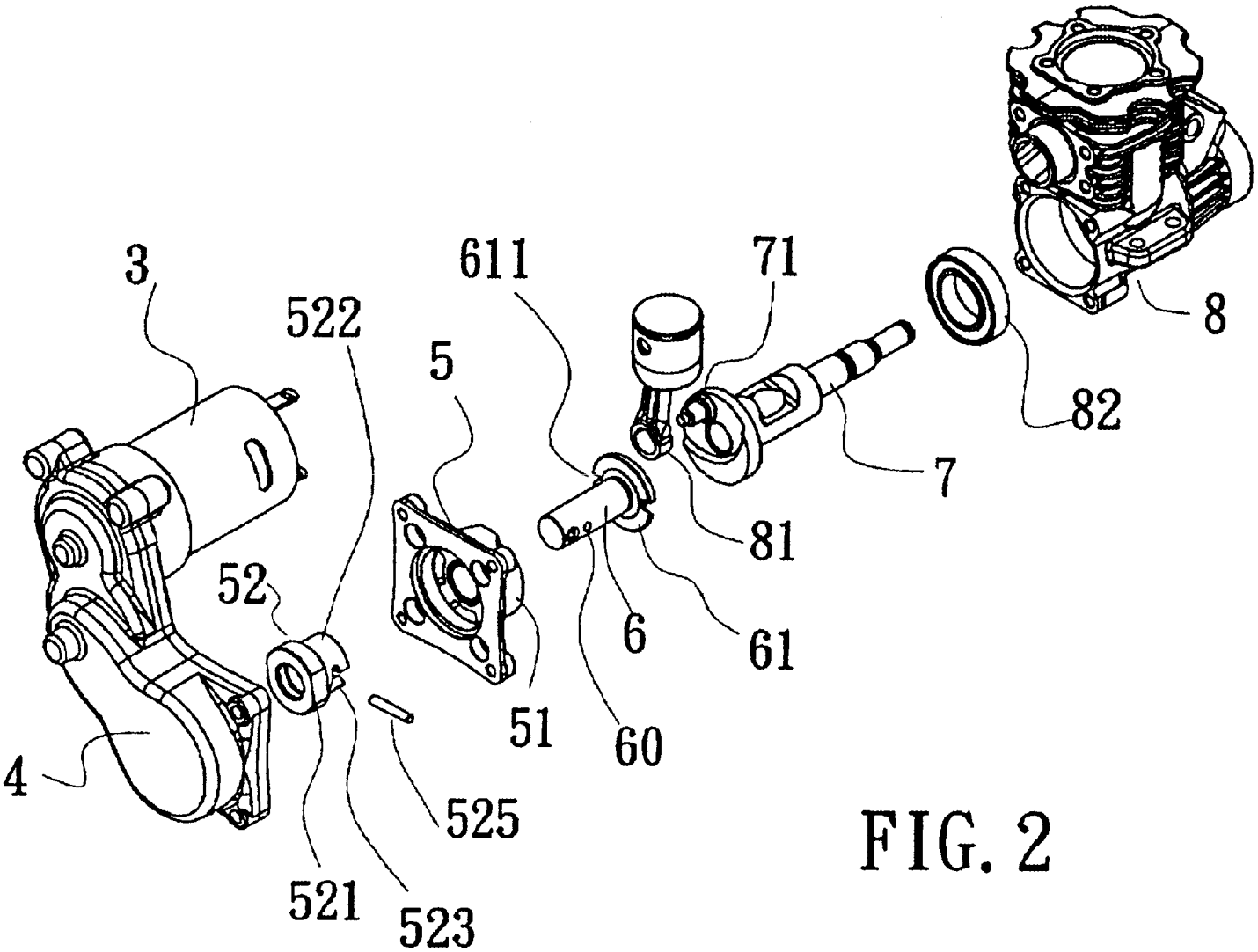
FIG. 2 is an illustrative exploded view showing component parts of the present invention.

Referring to FIG. 2, the component parts of the present invention comprise a starter which is further classified into a manual pull type and a motor operated type, but now a starting motor 3 of the latter will now be described accompanying with FIG. 3, the other components are a transmission mechanism 4, a rear cover 5, and a starter shaft 6 to couple with a rear engine shaft 7.

Figure 5:
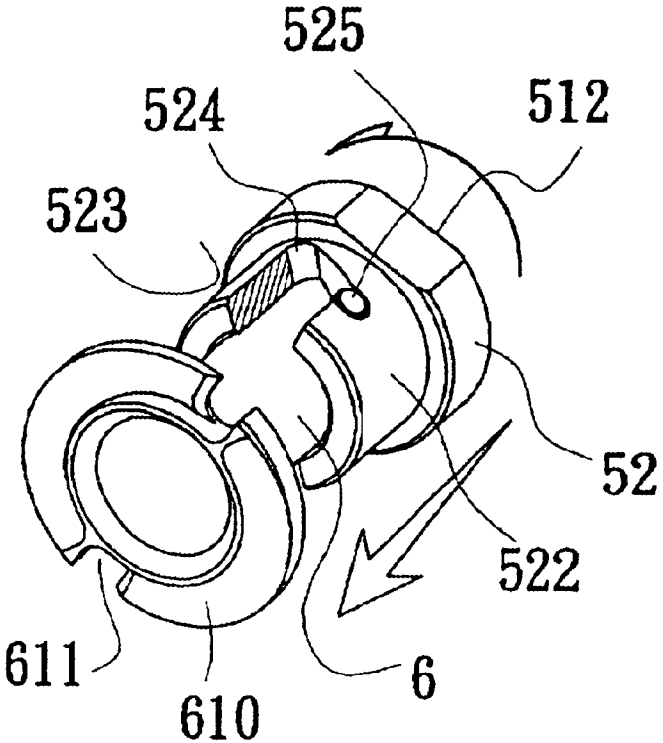
FIG. 5 is an assembly view of the car engine with its starter shaft and the slip bushing according to the present invention.

Output power of the starting motor 3 is transmitted by the transmission mechanism 4 having a gear set inside and being connected to the rear cover at its output side. The other end of the rear cover 5 is conjoined with a sleeve 51, which has a slip bushing 52 inside. As shown in FIGS. 2 and 5, one end of the slip bushing 52 is formed into a collar 521, while the other end thereof is formed into a sleeve 522. A longitudinal slanted groove 523 having recesses 524 provided at its both ends is formed on the outer surface of slip bushing 52.

Figure 3:
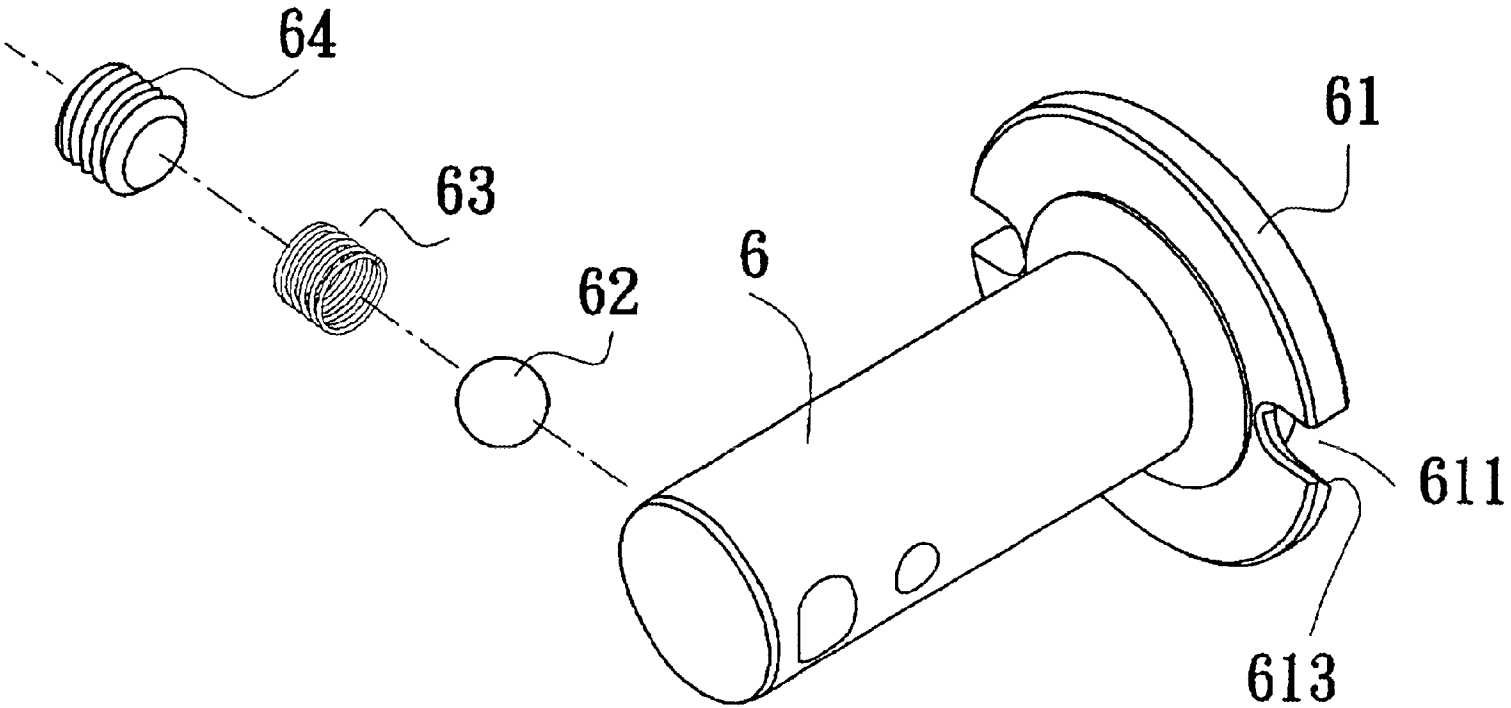
FIG. 3 is an illustrative exploded view of the starter shaft of the present invention.
Figure 4:
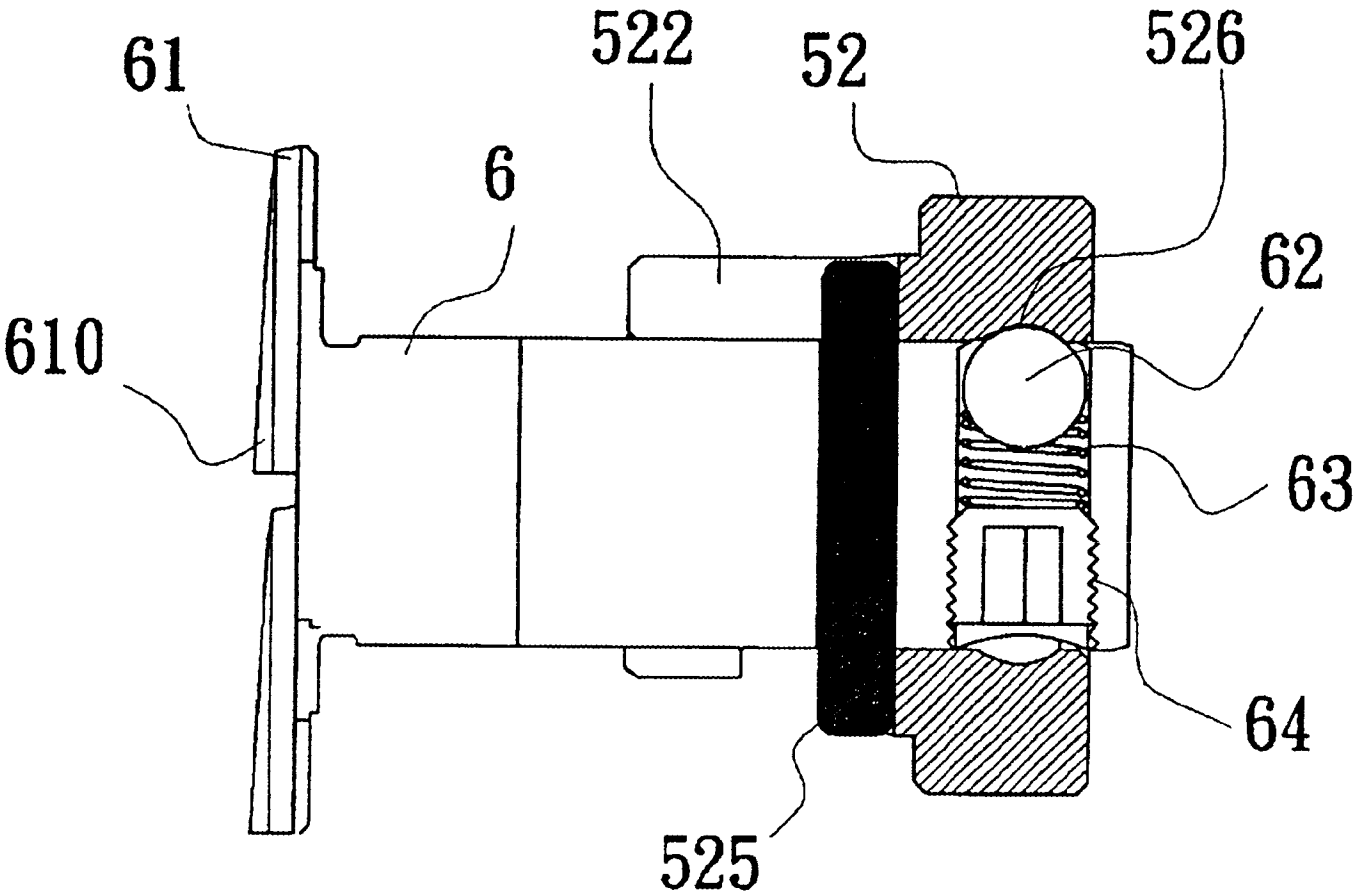
FIG. 4 is a cross-sectional view for the assembled starter shaft and the slip bushing of the present invention.

Referring to FIGS. 3 and 4, when the starter shaft 6 is inserted into the slip bushing 52, a pin 525 is perforated radially the starter shaft 6 and the slanted groove 523 so as to fasten the starter shaft 6 and the slip bushing 52 together. There is a containment hole provided in the starter shaft body 6 to accommodate a steel ball 62, a coil spring 63, and a set screw 64. The steel ball 62 clogs in an inner annular slot 526 formed on the slip bushing 52 so as to fix the retrieved starter shaft 6 at a relevant position after completion of engine starting. A coupling plate 61 formed at one end of the starter shaft 6 has two inlet notches 611 for a coupler 71 of a rear engine shaft 7 to inlay. The end surface of the starter shaft 6 facing to the coupler 71 is formed into a slanted surface 610 (see FIG. 6) and two chamfered edges 613 are provided with which the slanted surface 610 is extended to the inlet notches 611.

Returning to FIG. 2, a piston rod 81 mates with the coupler 71 of the rear engine shaft 7, while the piston is installed in the engine 8, and the rear engine shaft 7 is encircled by a bearing 82.

Figure 7:
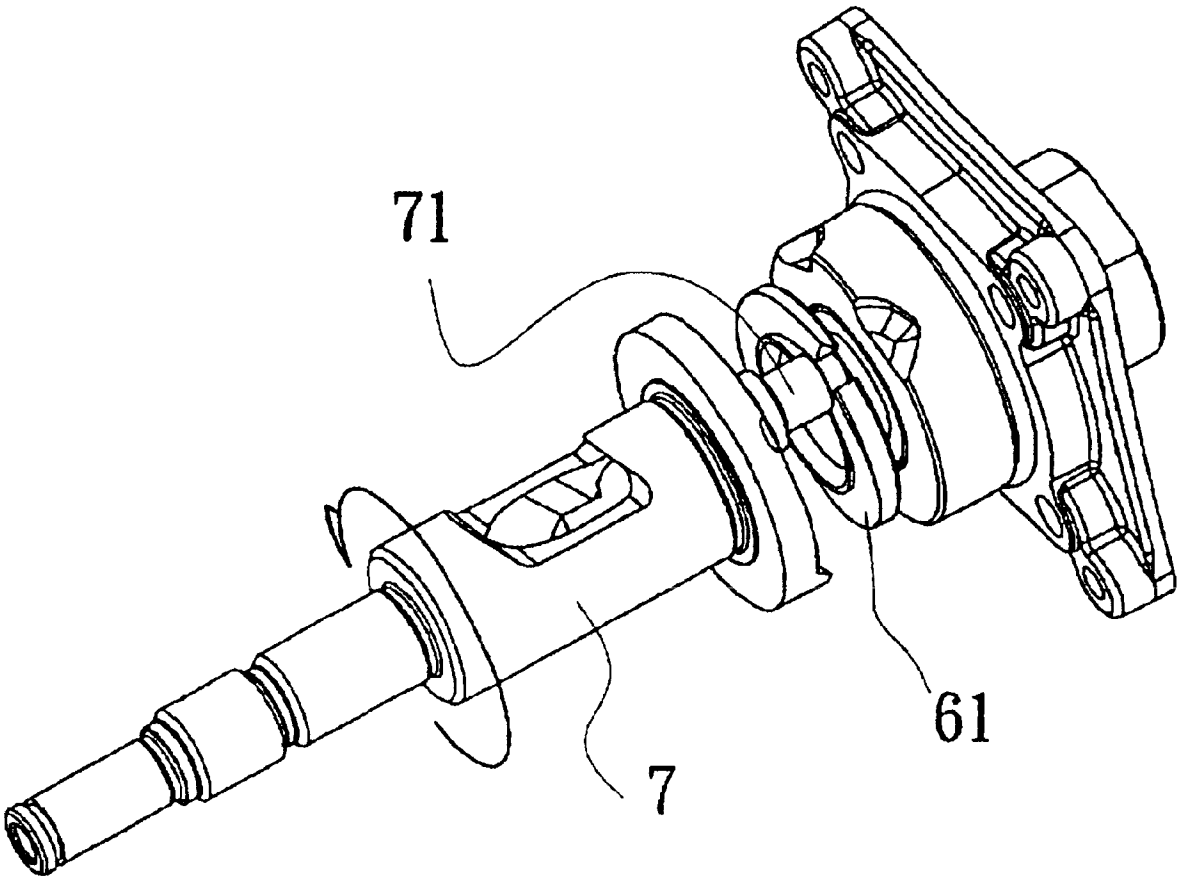
FIG. 7 is an illustrative view showing that the engine is operating at a high speed independently of the starter according to the present invention.

Here, the operation of the mechanism according to the present invention will be described with reference to FIGS. 5 and 7. As soon as the starting motor 3 starts to rotate, the slip bushing 52 is also rotated by the transmission mechanism 4 and the starter shaft 6 moves along the slanted groove 523 until the pin 525 is inserted into the front recess 524. The forward displacement of the starter shaft 6 causes the coupler 71 of the rear engine shaft 71 to engage with the inlet notches 611 formed on the coupling plate 61 such that the engine is driven to initiate.

Figure 6:
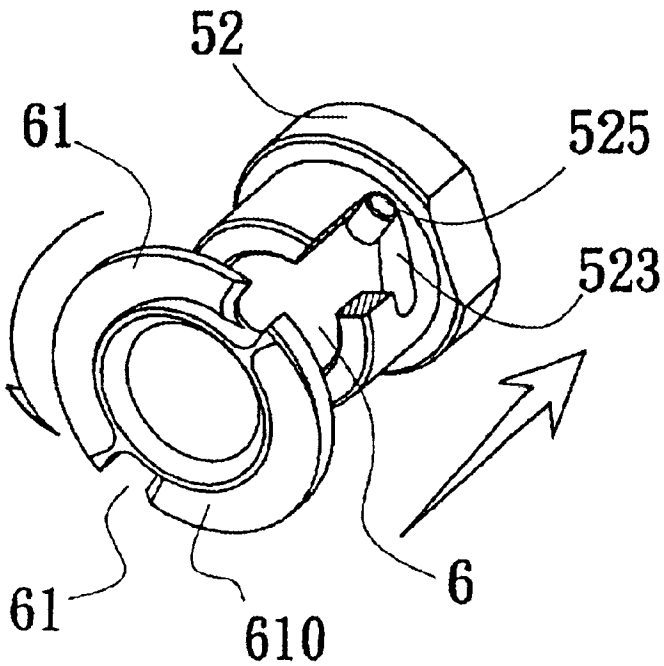
FIG. 6 is a three dimensional illustrative view showing that the assembled starter shaft and the slip bushing are separated from the car engine according to the present invention.

Referring to FIG. 6, when the engine rotation reaches its normal speed, the engine rear shaft 7 instantaneously rotates in reverse direction with respect to the coupling plate 61 of the starter shaft 6 causing the coupler 71 to move towards the other ends of the inlet notches 611 along chamfered edges 613 and the slanted surface 610 so as to disengage with the inlet notches 611 thereby the starter shaft 6 is free to retrieve until the pin 525 is inserted into the rear recess 524, at this moment, the steel ball 62 clogs in the inner annular slot 526 so as to avoid unexpected forward excursion of the starter shaft 6 to contact the rear engine shaft 7 again due to engine vibration.

It will be understood from the above description that the present invention has several significant merits compared with any conventional techniques, namely:

1. The starter shaft can perform a perfect separation from the rear engine shaft with the aid of the slanted surface and the chamfered edges formed on its coupling plate when the engine builds up its normal speed.
2. The retrieval starter shaft never forwardly excurses to recontact the rear engine shaft due to engine vibration by elaborating designed steel ball positioning means.
3. This perfect starter shaft separation feature makes the starter of the present invention applicable to those engines operated at an extra high speed.

While the present invention has been particularly shown and described with reference to a particular embodiment thereof, it will be understood by those skilled in the art that various changes in form and detail may be effected therein without departing from the spirit and scope of the invention as defined by the appended claims.

What is claimed is:

1. A starter (device) for a remote controlled miniature model car comprising:

a transmission mechanism including a gear set, a rear cover provided at an output side terminal, a sleeve with an inner slip busting being attached to said rear cover; and a starter shaft having a first end inserted into said slip bushing, and a second end formed into a flared coupling plate so as to engage with a coupler of a rear engine shaft;

wherein the slip bushing includes a longitudinal groove, when said starter shaft is inserted into said slip bushing, a pin is inserted through said starter shaft and said groove so as to fasten said starter shaft and said slip bushing together, said coupling plate formed at the second end of said starter shaft for engaging with said coupler of the rear engine shaft has a slanted surface such that said starter shaft is able to slidably reciprocate on said groove at an interval limited by said pin, after the engine builds up its normal speed, said coupler and said starter shaft are disengaged and the latter retrieves smoothly with the aid of said slanted surface such that the extra loss of frictional and mechanical power is saved.

2. The starter of claim 1, wherein said longitudinal groove formed on said slip bushing is slanted.

3. The starter of claim 1, wherein said longitudinal groove formed on said slip bushing has a recess on each end thereof.

4. The starter of claim 1, wherein said starter shaft is engaged with said coupler of the rear engine shaft by two inlet notches formed on said coupling plate, and a chamfered edge is formed between each inlet notch and said slanted surface.

5. The starter of claim 1, wherein a containment hole is provided in said starter shaft body to accommodate a steel ball, a coil spring, and a set screw, said steel ball clogs in an inner annular slot formed on said slip bushing so as to stably position said starter shaft.

6. The starter of claim 1, wherein said motor for said starter is electrically driven.

7. The starter of claim 1, wherein said motor for said starter is manually operated by pulling a rope wound on its shaft.

* * * * *